United States Patent [19]

Cramer

[11] 4,282,636

[45] Aug. 11, 1981

[54] CHAIN GUIDE FOR A STENTER

[75] Inventor: Hans Cramer, Aachen, Fed. Rep. of Germany

[73] Assignee: H. Krantz GmbH & Co., Aachen, Fed. Rep. of Germany

[21] Appl. No.: 60,336

[22] Filed: Jul. 25, 1979

[30] Foreign Application Priority Data

Aug. 3, 1978 [DE] Fed. Rep. of Germany ..... 2834007

[51] Int. Cl.[3] ..... D06C 3/02

[52] U.S. Cl. ..... 26/91

[58] Field of Search ..... 26/93, 86, 96, 91

[56] References Cited

U.S. PATENT DOCUMENTS

| | | | |
|---|---|---|---|
| 2,729,874 | 1/1956 | McCreary | 26/91 |
| 3,418,702 | 12/1968 | Coburn | 26/91 |

*Primary Examiner*—Robert Mackey

*Attorney, Agent, or Firm*—Arthur B. Colvin

[57] ABSTRACT

A chain guide for a stenter comprises head pieces and end pieces, each carrying a respective return wheel for the associated chain, each head piece being pivotally connected to an associated guide rail so that it can be swung out about a vertical axis and each end piece being displaceable outwardly while remaining parallel to the guide rails. The arrangement allows vertical chain reversal while still allowing clips to be carried by the chain and to engage and disengage a web satisfactorily.

2 Claims, 3 Drawing Figures

1
2
3
4
5
7
7
8
8
9
9
10
11

1
6
7
8
9
10
11
12
13
14
15
18
19

CHAIN GUIDE FOR A STENTER

The invention relates to a chain guide in a single layer stenter comprising a pair of guide rails having return wheels mounted on head and end pieces, the axes of the return wheels lying generally horizontally.

Chain guides having horizontal chain reversal, that is to say having return wheels whose axes are generally vertical, are known and used with chains which mount pins for engaging cloth to be stentered. A chain guide is also known which has vertical chain reversal, that is to say the return wheels rotate about generally horizontal axes. Such a construction lowers production costs, since the distance from a tension roller, from which a web to be stentered is supplied, to the point at which the web is gripped by the chains can be made shorter. Also, the engagement of the web by the needles is much easier with perpendicular chain reversal, because the chain links take up a polygonal disposition, as they leave the wheels, in a vertical plane and are in a straight line when viewed from above. In contrast, with horizontal chain reversal, the polygonal disposition of the links and the associated needles is in a horizontal plane and the needles move inwardly as the chains leave the wheels. Thus, the web cannot be engaged by the needles until the needles have reached their linear travelling paths. Generally, as a result of this shifting of the point at which the needles engage the web, about $2\times500$ mm of the potentially useful chain length are lost.

The advantages which are bound up with vertical chain reversal are recognized in the profession and in the case of stenter chains which are equipped with needles, vertical chain reversal is preferred to horizontal chain reversal.

When stenter chains are equipped with clips- or with combined clip- and needle links, however, horizontal chain reversal has always been used, since the clipping-in and clipping-out operation has not seemed feasible with perpendicular chain reversal.

An object of the present invention is to provide a chain guide for a single layer stenter wherein vertical chain reversal is possible using chains which have clips or combined clip and needle links without the clipping-in and clipping-out operation being hindered.

Accordingly, the invention provides a chain guide, for a stenter which has a pair of guide rails and two pairs of return wheels and wherein vertical chain reversal occurs, wherein head pieces and the end pieces, which carry the wheels, are pivotally connected to the guide rails in such a way that the head pieces can be swung out to lie at an angle to the guide rails and the end pieces carrying the return wheels are each displaceable outwardly while remaining parallel to the guide rails.

As a result of the hinged mounting of the head and end pieces, the gauge of the pair of chains can not only be varied in parallel manner, but can be widened in the clipping-in and clipping-out regions so that the closing and opening operation of the clips is not hindered by the web running in or off. With the invention, the actual chain reversal takes place so far outside the edges of the web that the clipping-in and clipping-out operations can be carried out in an orderly manner. As a result of the invention, the clipping-in location moves somewhat rearwardly in the direction of travel of the web and the clipping-out location moves somewhat forwardly in the direction of travel of the web. Moreover, with the chain guide of the invention all the advantages of vertical chain reversal are retained.

In accordance with a preferred feature of the invention, a threaded nut is fastened rigidly to the outside of each head piece and is engaged by a threaded spindle, a free end of which is held in a mounting which is swingably fastened to the respective guide rail.

This allows pivoting of the head pieces to be carried out simply. It is particularly advantageous to arrange hinge springs at the joints in the guides so that each chain is continuously guided even when the head pieces are swung outwardly.

In accordance with a further refinement of the invention, intermediate pieces are provided between and hingedly attached to the end pieces and the guide rails, the end pieces being provided with threaded nuts through which passes a threaded spindle which over one half has right-hand thread and over the other half has a left-hand thread and which can be rotated to vary the separation of the end pieces.

As a result of this refinement, the separation of the end pieces can be effected in a particularly advantageous manner to allow variation of the gauge of the stenter so that also the clipping-out point lies in front of the return region, and the clipping-out operation can be accomplished in unhindered manner.

The invention will be described further, by way of example, with reference to the accompanying drawings, in which.

Figure 1:
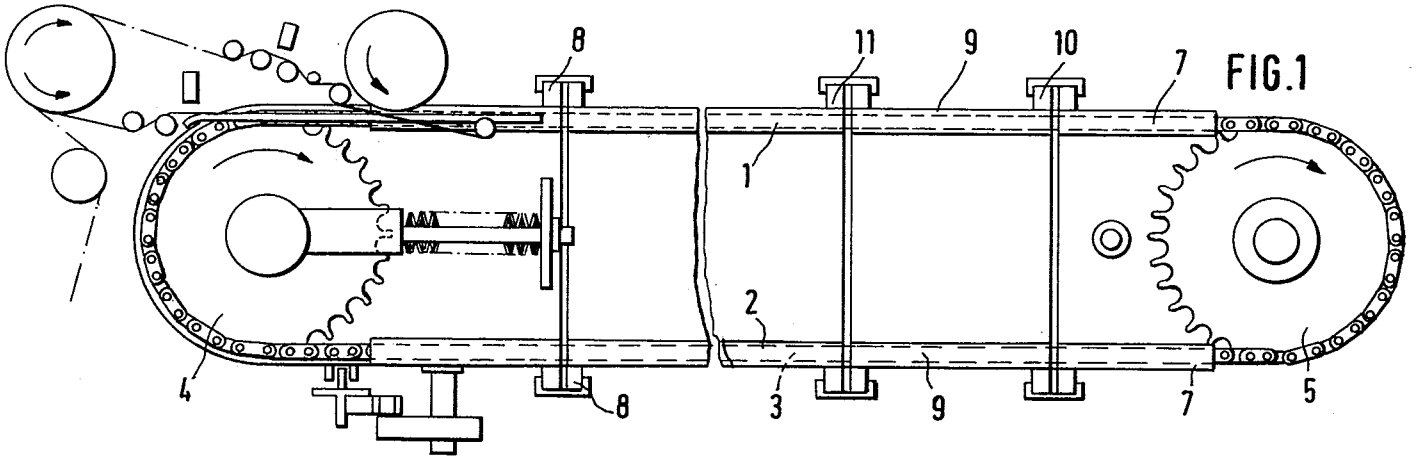
FIG. 1 is a side view of a stenter having a preferred chain guide of the invention.
Figure 2:
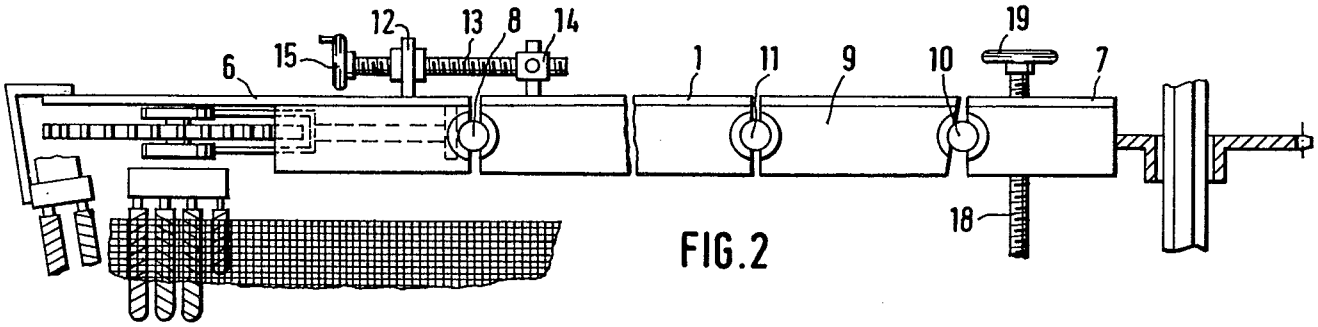
FIG. 2 is a plan view of one side of the chain guide disposed for use when needles are carried.

In the drawings only one guide rail 1 for forward travel and one guide rail 2 for return travel of a chain 3 are shown. These rails 1 and 2 are, of course, part of a pair arranged parallel to each other. The endless chain 3 is conducted over return wheels 4 and 5, which are mounted between head pieces 6 and end pieces 7, respectively.

The head pieces 6 are pivotally connected by way of a hinge 8 to the guide rails 1 and 2, while the end pieces 7 are pivotally connected by way of intermediate pieces 9 by hinges 10 and 11 to the guide rails 1 and 2.

Fastened to each head piece 6 is a threaded nut 12, through which passes a threaded spindle 13, a free end of which is attached to a mounting 14 pivotally fastened to the associated guide rail 1. Turning of a hand wheel 15 on the spindle 13 pivots the head pieces 6 outwardly about the hinge 8.

Figure 3:
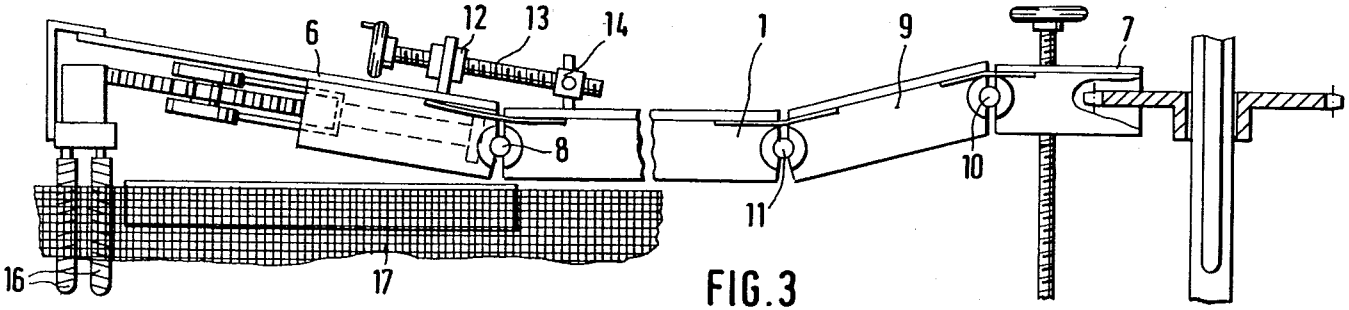
FIG. 3 is a view similar to that of FIG. 2 but with the guide disposed for use with chains carrying clips.

On the upper head pieces 6, finger-like selvedge straighteners 16 are so arranged at an angle to the length of the head pieces 6 that in the swung-out position of the head pieces 6 (FIG. 3) they lie perpendicular to the direction of travel of a web 17 and can thus fully fulfill their rolling-out function.

A threaded spindle 18 is so associated with the end pieces 7 that, upon turning a hand wheel 19 on the spindle 18, the end pieces 7 are moved outwardly. At the same time the intermediate pieces 9 pivot about the hinges 10 and 11.

As the head pieces 6 and the end pieces 7 move, so also do the return wheels 4 and 5 so that the chain guide of the invention does not hinder either the clipping-in nor clipping-out.

Having thus described my invention, what I claim as new and desire to secure by Letters Patent of the United States is:

1. In a stenter, a chain guide comprising a pair of guide rail assemblies, each said guide rail assembly including a pair of return wheels, a chain mounted on said wheels and arrayed for vertical reversal, one said wheel being carried by a head piece and the other said wheel being carried by an end piece, first pivot means connecting said head piece to said guide rail assembly for pivotal movement in an outward angular direction relative to said guide rail assembly, second pivot means interposed between said end piece and said guide rail assembly for enabling said end piece to be shifted outwardly while remaining parallel to said guide rails, a threaded nut secured to said head piece, a threaded spindle extending through said nut, a mounting member pivotally secured to said guide rail assembly, said spindle including a free end secured to said mounting member whereby the angle of said head piece relative to said guide rail assembly may be varied by rotation of said spindle.

2. A chain guide in accordance with claim 1 wherein said second pivot means includes intermediate pieces disposed between and pivotally connecting said end pieces to said guide rail assembly, each said end piece including a threaded nut, a threaded end adjustment spindle threadedly connected to said threaded nuts of said end pieces, said end adjustment spindle having a right hand thread engaging one said nut, and a left hand thread engaging the other said nut whereby rotation of said end adjustment spindle shifts said end pieces in opposite directions.

* * * * *